United States Patent [19]

Rundsztuk et al.

[11] Patent Number: 5,034,731

[45] Date of Patent: Jul. 23, 1991

[54] AUTOMATIC APPLIANCE ELECTRIC STATE SIGNALLING LABEL

[75] Inventors: Marek Rundsztuk, Enghien Les Bains; Christian Cadet, Taverny; André Vergez, Villennes Sur Seine, all of France

[73] Assignee: Telemecanique, France

[21] Appl. No.: 481,534

[22] Filed: Feb. 20, 1990

[30] Foreign Application Priority Data

Feb. 21, 1989 [FR] France ..... 89 02217

[51] Int. Cl.[5] ..... G08B 21/00

[52] U.S. Cl. ..... 340/693; 340/635; 340/644; 340/660; 340/664

[58] Field of Search ..... 340/644, 635, 660, 664, 340/693

[56] References Cited

U.S. PATENT DOCUMENTS

| | | | |
|---|---|---|---|
| 4,250,501 | 2/1981 | Pokrandt | 340/644 |
| 4,504,830 | 3/1985 | Boehme | 340/635 |
| 4,929,932 | 5/1990 | Shipkowski | 340/644 |

*Primary Examiner*—Glen R. Swann, III

*Attorney, Agent, or Firm*—William A. Drucker

[57] ABSTRACT

The appliance according to the invention has a front face with retention means adapted for cooperating with fixing means belonging to a removable label with rank or function identification characters. This label is molded over an electronic circuit comprising at least one visible light-emitting component, this circuit being connectable to terminals provided on the appliance by means of electric conductors.

13 Claims, 5 Drawing Sheets

FIG. 1
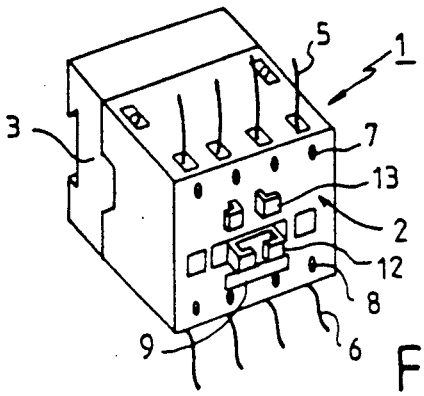
FIG. 2
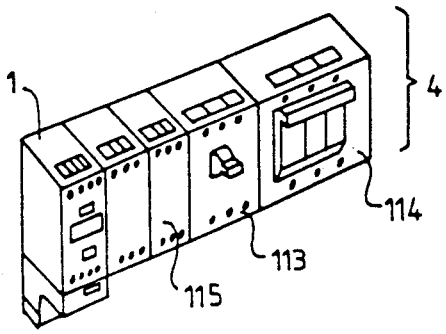
FIG. 4
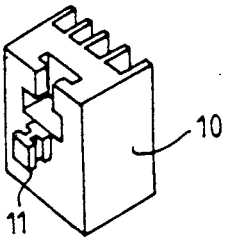
FIG. 3
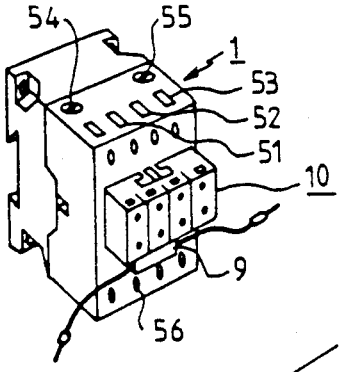
FIG. 6
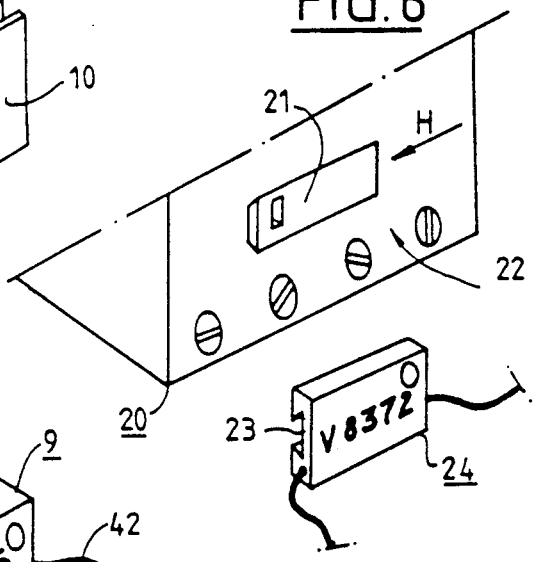
FIG. 5
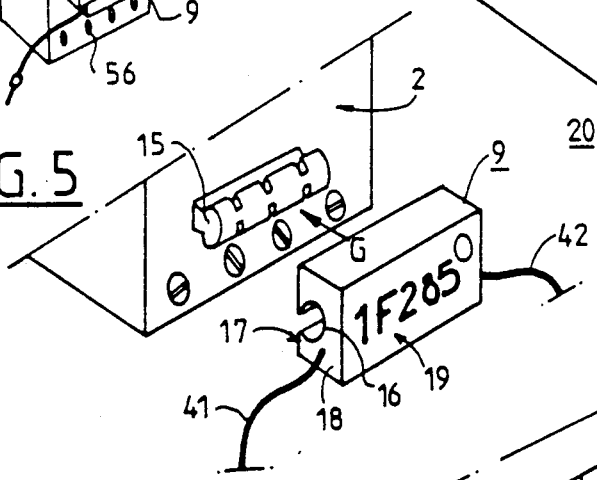
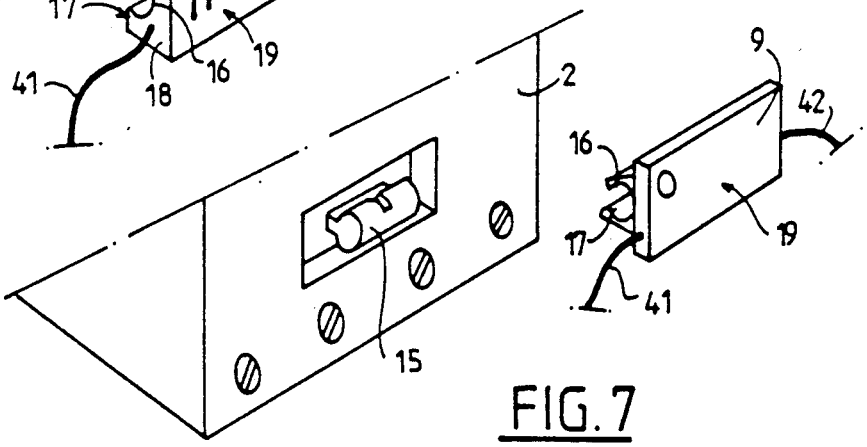
FIG. 7

FIG. 14
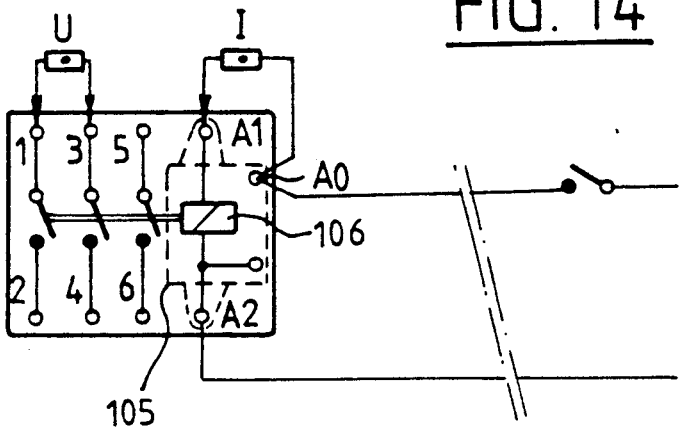
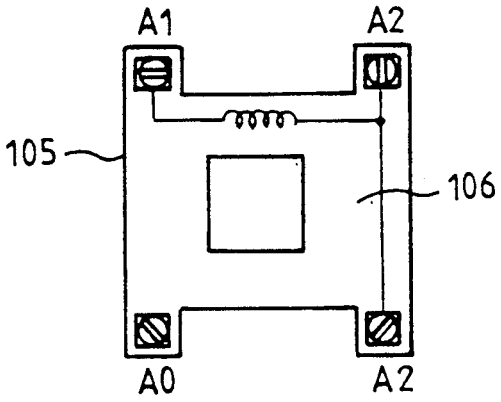
FIG.15
FIG.16a
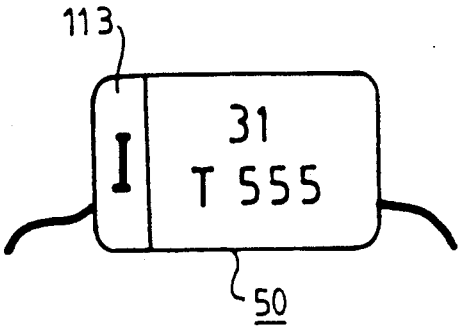
FIG.16b
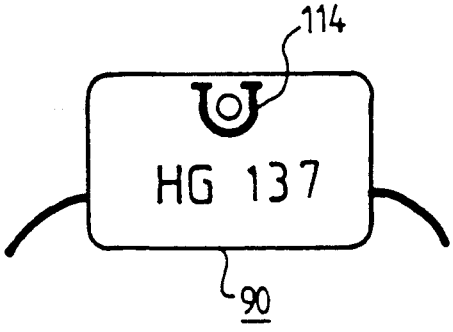

AUTOMATIC APPLIANCE ELECTRIC STATE SIGNALLING LABEL

BACKGROUND OF THE INVENTION

The invention relates to an automatic mechanism appliance with electric connection terminals having a front face which is opposite a fixing base and which has retention means adapted for cooperating with fixing means belonging to a removable label with rank or function identification characters.

Electric automatic mechanism appliances such as contact makers, thermal relays and, accessorily, isolating switches, circuit breakers or fuse boxes generally have on their front face a multiplicity of openings for clamping conductors in terminals in the vicinity of which are written standardized wiring references; fairly frequently, in all cases where internal parts are forced to move during changes of state of the appliance, coupling claws may appear in the plane of this front face so that means may be coupled thereto for controlling auxiliary contact blocks which may be time delayed or not, whose cases are themselves fixed to this face; in some cases, for example when it is a question of appliances such as thermal relays, rotary adjustment means or resetting pushers appear in the plane of the front faces.

The presence of these connection, coupling, actuating or adjusting means results in an extremely reduced area available for affixing to this front face means for identifying the rank or function which this appliance has or provides in a complete automatic system.

These identification means are generally in the form of removable labels which are secured to the front face of the appliance by locking means cooperating with retention means for example in the form of slides, or in the form of hooks, or cavities adapted for cooperating with corresponding means on the label.

A difficulty arises consequently when such appliances are provided with additional optical signalling means which are designed to inform the user or the maintenance staff of their electric state, in particular using their front face.

It has already been proposed to affix to such appliances state or voltage presence signalling means which are disposed in small auxiliary cases, placed on one of the lateral faces of the appliance which are perpendicular to the fixing plate or panel or to the front face.

When these side faces are inaccessible, for example if a series of appliances is formed by an association which places them one against the other, or else if some of these faces are occupied by functional cases electrically or mechanically associated therewith, as is the case for reciprocal locking means, or for interference protection means or for thermal relays, optical representation of the electric state of these different appliances can only be obtained by adding indicators or signalling lamps which will have to be disposed near-by on a surface portion of the plate or panel which, consequently, cannot be used for other purposes and which will correspondingly increase the volume of the cabinets receiving the automatic mechanism systems.

The fact of fixing to the doors or to the covers of cabinets, respectively cases receiving such installations, a portion of such signalling means in fact forms a costly solution permitting the general working and monitoring of the system, but which does not give the maintenance staff the possibility of acquiring rapidly and directly from the system the electric state relations which a multiplicity of appliances, each having a particular function, must present with respect to each other.

SUMMARY OF THE INVENTION

Consequently, the invention proposes disposing on the front face of electric appliances of the above mentioned kind and in a non limitative way, removable electric state signalling means which, on the one hand do not require a considerable additional front face portion and which, on the other hand, will not require a modification of the shapes of the front faces of existing appliances, while allowing the means (signs or symbols) to be kept which identify their rank or their function.

According to the invention, this object is attained because the label is formed by a block of insulating material of small thickness which is molded over an electronic circuit of reduced size, having at least one light-emitting component which can be observed on a front face of the block opposite the fixing means, whereas electric connection means are coupled to this circuit for forming its connection with chosen terminals of this appliance, a free portion of this front face being formed for receiving characters.

According to other objects of the invention, the new signalling label of this appliance will be designed for facilitating the electric connection, without encroaching on the area devoted to the significant text with minimum dimensions, or will include measures permitting the use of old labels or else will comprise an appropriate surface mounted component SMC circuit for emitting a light in a very small volume when certain current states, respectively voltage states, occur.

BRIEF DESCRIPTION OF THE DRAWINGS

The invention will be better understood from the following description, with reference to the accompanying figures, which show:

FIG. 1, a perspective view of an automatic mechanism appliance capable of receiving the invention;

FIG. 2, a multiplicity of automatic mechanism appliances associated side by side;

FIG. 3, a perspective view of a contact-maker appliance whose terminals can be connected to a label according to the invention wherein the front face is equipped with an auxiliary case;

FIG. 4, an auxiliary contact case able to be associated with the contact-maker of FIG. 3;

FIG. 5, a perspective view of a label according to the invention with first fixing means;

FIG. 6, a perspective view of a label according to the invention having second fixing means;

FIG. 7, a perspective view of a label according to the invention having third fixing means;

FIG. 14, a diagram for connecting a label according to the invention for signalling the presence of voltage and respectively the passage of a current;

FIG. 15, a view of a contact-maker coil equipped with a connection terminal for electric connection with the label;

FIGS. 16*a*, 16*b*, two possible presentations of signalling labels relating to a voltage and respectively to a current;

DESCRIPTION OF THE PREFERRED EMBODIMENTS

Figure 8:
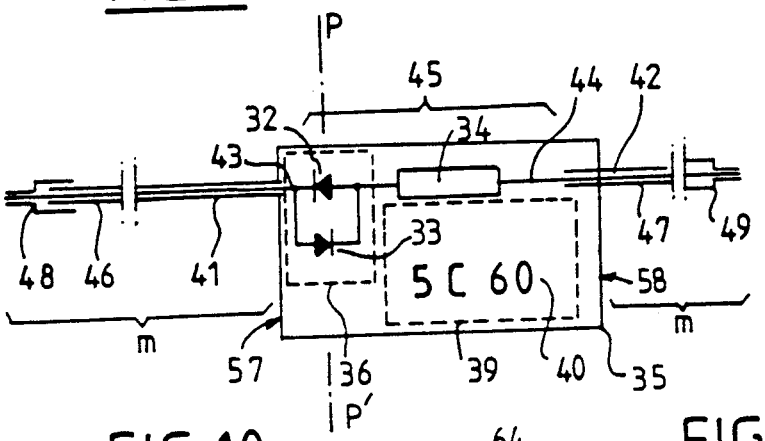
FIG. 8, a schematic elevational view of a signalling label according to the invention.

An electric automatic mechanism appliance such for example as a contact-maker 1 illustrated in FIG. 1, has a front face 2 opposite a fixing base 3. In a traditional mounting device, such an appliance is frequently placed in a row 4 of electric appliances of all kinds placed side by side and shown in FIG. 2, so that, considering the presence of upper 5 and lower 6 conductors connected to terminals such as 7, respectively 8, only the front face can be readily used for carrying a rank or function identification label such as 9.

The dimensions of this label are further necessarily reduced if we take into account the possibility offered to the user to associate with the front face of appliance 1 auxiliary devices such for example as a contact case 10 which has a time delay or not, see FIG. 3.

Such a case 10 and its mounting means 11 are fixed to this front face, for example through the presence on the latter of association means, one fixed 13 and the other mobile 12, see FIG. 1 and FIG. 4.

In FIG. 5, it can be better seen how a removable label 9 according to the invention may be fixed to the front face 2 by clipping, through projecting retention means carried thereby, such as 15, which cooperate in direction G with recessed securing means 16 placed on the rear face 17 of a plate 18 of small thickness situated opposite the front face 19 which will receive alphanumeric signs for identifying the rank and/or the function of the contact-maker in a complex system.

The association means illustrated above, by way of non limitative examples, could be of another kind, comprising as in FIG. 6 a dovetail 21 placed on the front face 22 of an appliance 20 and a groove 23 of complementary shape placed at the rear of label 24, positioning taking place here in direction H.

It is obvious that the retention and securing means shown may be recessed or in relief on any one of the parts to be assembled, provided that measures are taken which are within the scope of a man skilled in the art, see FIG. 7.

Figure 9:
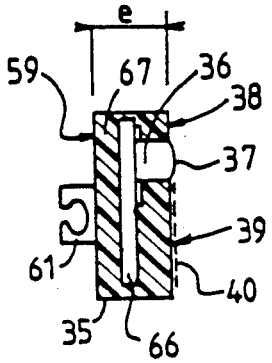
FIG. 9, a sectional view of this label through the plane PP' of FIG. 8.
Figure 12:
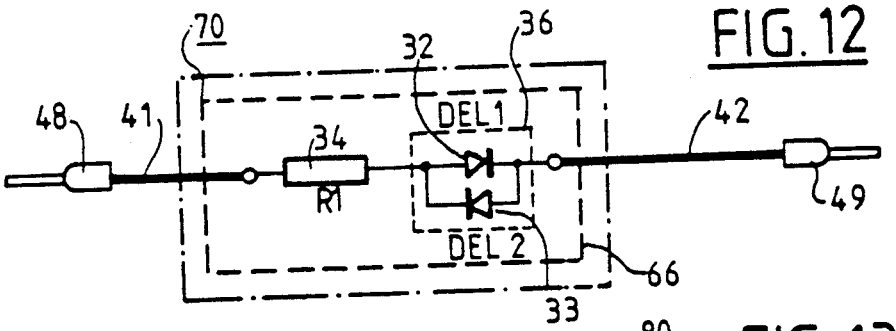
FIGS. 12 and 13, two types of signalling circuits which may be incorporated in the body of a label according to the invention.

A label according to the invention and associated with an appliance such as shown in FIGS. 8 and 9, comprises a simple electric circuit 45 such as the one illustrated by way of example in FIG. 12, whose components 32, 33, 34 are over-molded into a block of small thickness or an insulating material plate 35 (FIG. 9). These components are here formed by a resistor R1-34 placed in series with two photodiodes DEL 1, DEL 2-32, 33 mounted anti-parallel fashion and themselves combined in the same capsule 36. It will be noted that the use of such a capsule has a considerable advantage with respect to that of two unidirectional diodes mounted anti-parallel fashion in the same circuit; this advantage resides in the fact that, on the one hand, double handling of the components is avoided, which results in a technically advantageous saving of time and, on the other hand, possible orientation errors are avoided, which reduces the control means and eliminates corresponding manufacturing defects. A transparent face 37 of this capsule reaches the level of the front face 38 so as to be visible when the plate is positioned. This front face further comprises a free surface portion 39 on which are affixed rank and/or function alphanumeric signs 40, by printing or fixing with adhesive means.

Two flexible and insulated conductors 41, 42, whose internal ends 43, 44 are connected electrically to the terminals of circuit 45, are fixed to the plate during molding. Free ends 46, 47 of these conductors, possibly equipped with connecting end-pieces 48, 49, must allow the signalling circuit to be connected to terminals of the appliance situated or not in the immediate vicinity, as is the case if it is desired to make visible the presence of a voltage between phase terminals 51, 52, 53 in the vicinity of the front face 2 of the appliance or that existing between the terminals of a coil 54, 55 energizing an electromagnet of the contact-maker appliance, see FIG. 3, which are frequently further away from this face.

Apart from the sufficient lengths -m- which such conductors must then have, the sheaths thereof will advantageously have different colors depending on the voltage values to be examined, for example for the following ranges : 24–48 volts, 110–220 volts, 380...500 volts.

In order to pass such conductors through regions of the front face which do not encroach on those devoted to the screws for clamping the terminals such as 56, see FIG. 3, they will preferably extend from two opposite lateral faces 57, 58 of the plate, see FIG. 8.

Figure 10:
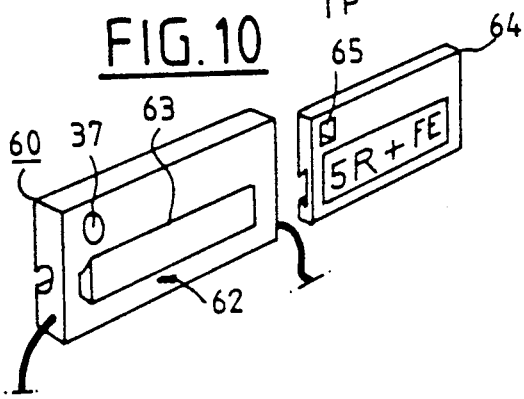
FIGS. 10 and 11, a first and second modification of the signalling lab el.

As in conventional labels, which the state-signalling labels are intended to replace, the rear face 59 has securing means 61 adapted for cooperating with retention means described above. It is also possible, see FIG. 10, to place on the front face 62 of a signalling label 60 second retention means 63 for receiving an added character carrier 64, in accordance with those of the prior art.

Figure 11:
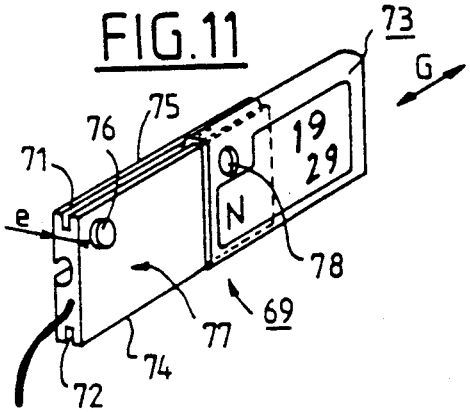

If this carrier necessarily has a size equal to that of the signalling label, it will be advantageously made from a transparent or translucent material for allowing the light to pass; with a particular local conformation 65 of this transparent or translucent material, it is possible to obtain diffusion, of the radiation emitted locally by the photodiode, in the mass of this material so as to make the voltage parameter observed more visible. Finally, an enveloping character carrier with C section, 73, may be slid in direction G along parallel grooves 71, 72 formed along walls 74, 75, separate from those where the conductors terminate, in a particular signalling label 69, see FIG. 11.

If the capsule of the photodiode 76 is allowed to project slightly from the front face 77, which has the further advantage of reducing the thickness -e- of the body of the signalling label, this excrescence may be used for holding the character carrier 73 in position in direction G of the carrier by penetration into an opening 78 thereof. Lighting through the edge of such a transparent carrier may also be obtained with the means which have just been described.

Figure 13:
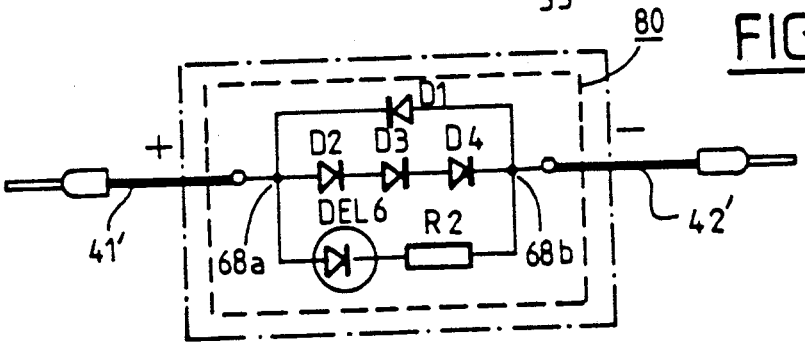

The construction of a state-signalling label body, having a small thickness -e- may be advantageously obtained using the Surface Mounted Component technique (abbreviated to SMC) for constructing an internal circuit signalling the presence of a voltage such as 70 or signalling the passage of a current such as 80, see FIG. 12, respectively FIG. 13. For this, a printed circuit board 66 whose conducting tracks receive the terminals belonging to components 36, 34 will be over-moulded in a mass of appropriate plastic material 67 having a small thickness -e-.

A circuit 80 for detecting the passage of a current such as shown in FIG. 13 and which may be incorporated in a label, allows the passage of a current reaching an intensity of about 1A, which is largely sufficient for energizing a contact-maker coil. The series diodes $D_2$, $D_3$, $D_4$ serve here for establishing a stabilized voltage between terminals $68_a$, $68_b$, whereas diode $D_1$ allows the passage of the current in the reverse direction. The light-emitting diode DEL 6 may here present only a single light element.

These two circuits shown may be used with voltages, respectively currents, which are direct or alternating; in the second circuit, it is only necessary to respect a particular connecting polarity if it is a question of a DC current. Possible confusion between the two types of labels intended for the detection of current, respectively voltage, may be avoided by giving appropriate colors to the conductors or to the bodies of the labels.

Furthermore, the use of a label signalling the passage of a current can only be made possible if there is available on the appliance or in its vicinity a free terminal Ao so that series connection may be made, for example, with an electromagnet coil, see FIG. 14. In this case, this terminal may be placed on the field spool 105 of coil 106, see also FIG. 15.

It is naturally possible to affix to the label according to the invention a rank or function reference using the standardized bar code.

Figure 20:
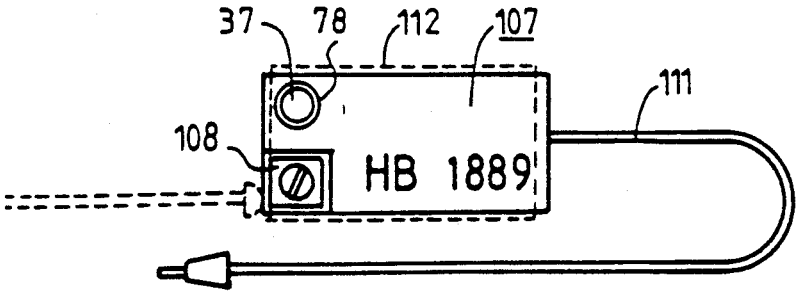
FIG. 20, one embodiment of a label having a certain interest for signalling the passage of a current.

In a variant, the current-signalling label 107 may be provided with its own screw terminal 108 and a conductor 111 of appropriate length, see FIG. 20. This terminal could advantageously then be protected against accidental contacts by a character carrier 112 of the type illustrated in one of the FIGS. 10 or 11. Such a label is particularly appropriate for signalling the passage of a current, terminal 108 then having a function identical to that of terminal Ao.

Figure 21:
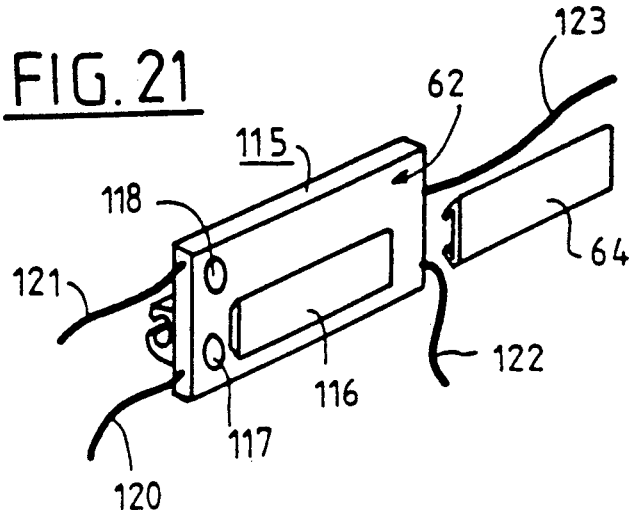
FIG. 21, a label according to the invention with means for signalling the state of two electric parameters.

If, for more complete information for the user, the same label 115 is to signal both the passage of a current and the presence of a voltage, the two types of circuit will be integrated in the same body 116 and, if required, light-emitting diodes 117, 118 will be chosen of different colors for distinguishing these two parameters, see FIG. 21.

Figure 22:
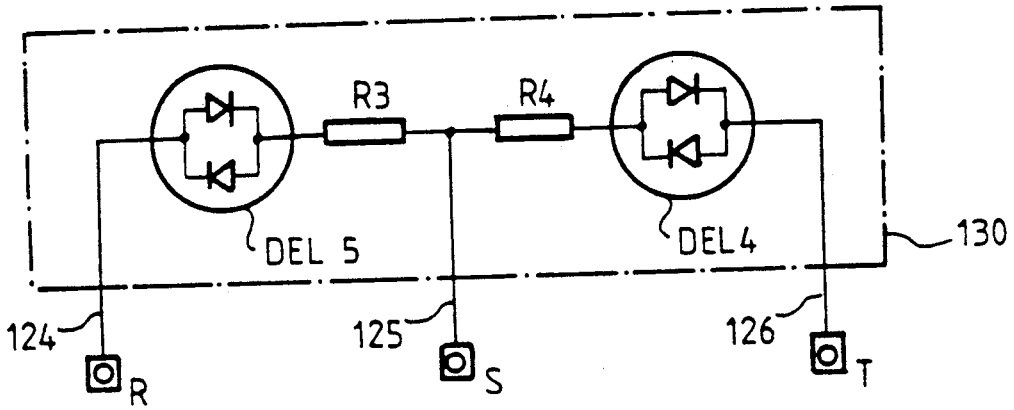
FIGS. 22 and 23, two circuit diagrams which may be used for signalling voltage faults in a three phase network.

In a particular construction of the circuit shown in FIG. 22, with only two pairs of light-emitting diodes DEL 5, DEL 4, a voltage defect may be detected on each of the three phases of a three phase network RST, connected by conductors 124, 125, 126 to the signalling label 130.

Voltage failure in one of the phases R or T results in extinguishing the light-emitting diode which is the nearest thereto, whereas a voltage failure in phase S will result in substantial weakening of the light emitted simultaneously by the two diodes as long as the values of resistors R3 and R4 are chosen appropriately.

Figure 23:
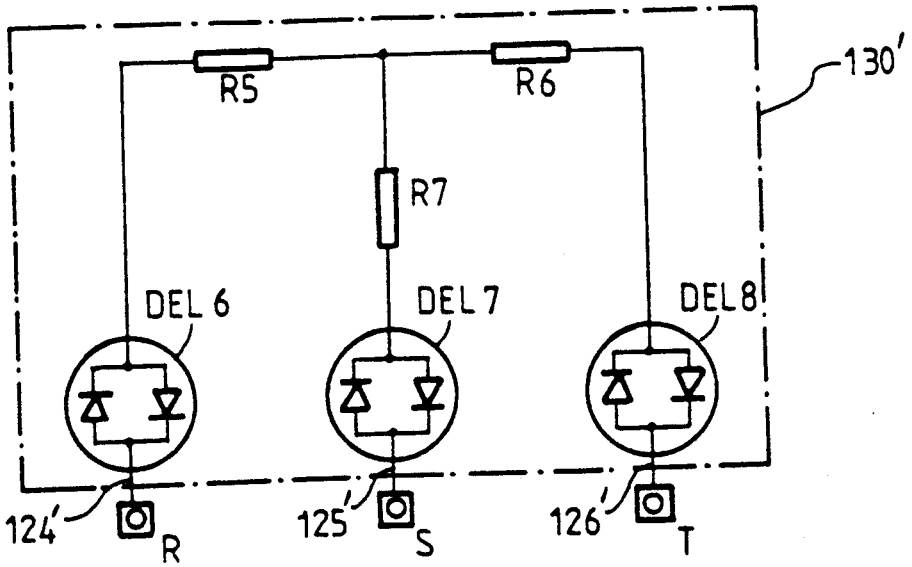

Considering the variations of illumination characteristics of light-emitting diodes, it is not always easy to obtain the above-mentioned weakening. To adapt to such variations, a symmetrical circuit may be chosen such as shown in FIG. 23, wherein a star connection is used in each branch of which is placed a pair of diodes DEL 6, DEL 7, DEL 8 connected in anti-parallel fashion and disposed in series with a resistor of appropriate value R5, R6, R7; the label 130' then comprises three connecting conductors 124', 125', 126'.

Figure 19:
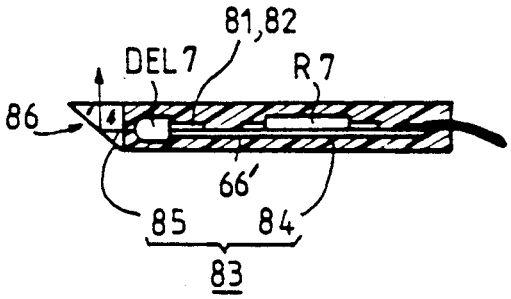
FIG. 19, a sectional view of a label according to the invention providing marginal lighting.

In a second embodiment of the body of the signalling label, it may be formed so that the knowledge of the state is obtained, not through direct observation of the capsule of the photodiode, but through an intermediate reflection in a portion of the transparent body. Such an embodiment, which is shown in FIG. 19, uses a photodiode DEL 7 whose electrodes 81, 82 are for example substantially parallel to the initial light emission direction so as to be able to be readily soldered to the edge of a printed circuit board 66' using the SMC technique.

The molded body 83 may comprise an opaque portion 84 for here covering the electric components DEL 7 and R7 and, necessarily, a transparent portion 85 which may be reflective if required for transmitting the light to at least one edge 86 of the front face of the label.

The existence of these two embodiments may be used for obtaining two different types of labels, one 50 illuminating for example on the edge 113 for signalling the passage of current I and the other 90 on the front face 114 for signalling the presence of a voltage U, see FIGS. 16*a* and 16*b*.

Figure 17:
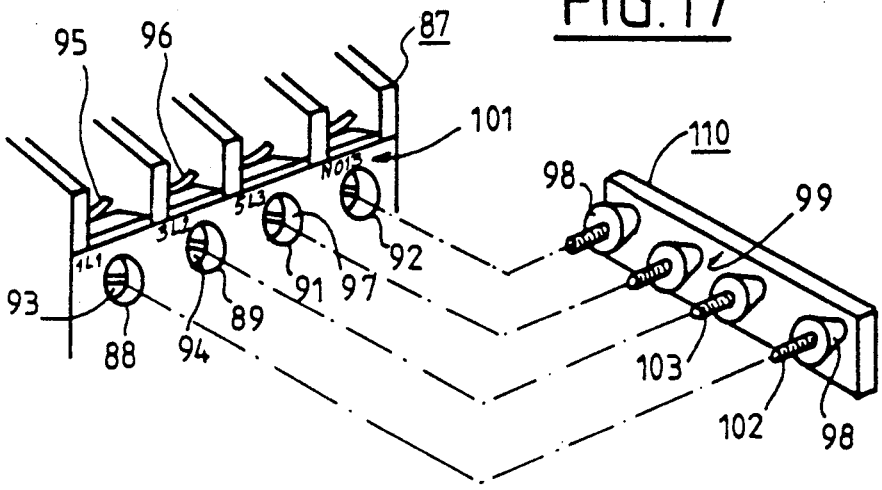
FIG. 17, a contact-maker appliance and a particular label for cooperating electrically without external connection conductors.
Figure 18:
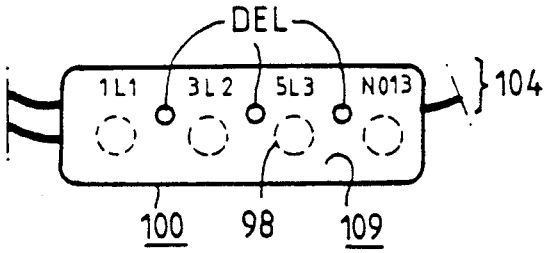
FIG. 18, a view of the front face of a voltage indicating label which may be adapted to the phases of a three phase network.

In a third embodiment of the invention, shown in FIGS. 17, 18, the means retaining the removable label 100 which belongs to appliance 87 may be formed by one or more openings 88, 89, 91, 92 giving access, on the front face 101 of the appliance, to clamping screws 93, 94,... of its terminals 95, 96...

These openings may for example have a slightly tapered inner surface 97 for efficiently holding in position studs of complementary shapes, such as 98, which project from the rear face 99 of the label. The latter may further advantageously recall on its front face 109 the standardized references 104 which also identify on appliance 87 each of the supply lines and the opening or closing function of switches associated with the terminals, see FIG. 18.

When the signalling label 110 is used for signalling the presence of a voltage at terminals 95, 96,... studs 98 may be advantageously provided with resilient conducting pieces such as 102, 103 for establishing electric contact with the heads of clamping screws of the facing terminals.

The removable nature of this label makes it possible at all times to remove it for accessing the screws.

It must be understood that though the label according to the invention has been defined within the scope of its association with a contact-maker appliance 1, it may also be used in association with a front face of any contact breaker 113, or isolating switch 114 or other 115 appliance, as shown in FIG. 2.

An auxiliary contact case such as 10, shown in FIG. 4, or any other auxiliary device associated with one of the appliances 1, 113, 114, 115 may also receive on its front face one of the signalling labels such as those defined above, the only condition being that the lengths of the connecting conductors are sufficient for reaching the terminals concerned of the appliance.

Finally, it should be understood that a state-signalling label having two connecting terminals such as those shown by the reference 108 in FIG. 20, would enter within the scope of the present invention, as long as it was designed for receiving two conductors permitting the establishment of the above-mentioned electric connections.

What is claimed is:

1. An automatic mechanism appliance with external electric connection terminals having a front face which is opposite a mounting base and which has retention means adapted for cooperating with mounting means belonging to a removable label with rank-or function-/identification characters, wherein said label is formed by a plate of insulating material which is molded over an electronic circuit, having at least one light-emitting component which can be observed on a front face of the plate opposite the mounting means, electric connection means being coupled to said electronic circuit for providing for its connection with chosen terminals of the appliance, a free portion of said front face of the plate being adapted for receiving said characters.

2. Automatic mechanism appliance as claimed in claim 1, wherein said electric connection means comprise at least one conductor terminating at a lateral face of said plate.

3. Automatic mechanism appliance as claimed in claim 2, wherein said electronic circuit is printed on a circuit board molded over said plate of insulating material.

4. Automatic mechanism appliance as claimed in claim 1, wherein said electric connection means comprise two conductors respectively terminating at two respective opposite lateral faces of said plate.

5. Automatic mechanism appliance as claimed in claim 4, wherein pairs of conductors of particular colors correspond to the presence of dropping resistors of different values which are required for connecting the label in parallel across different supply voltages.

6. Automatic mechanism appliance as claimed in claim 1, wherein said electric connection means comprise at least one connection terminal fixed to said plate.

7. Automatic mechanism appliance as claimed in claim 1, wherein said electronic circuit comprises two light-emitting diodes mounted anti-parallel in a capsule and placed in series with at least one dropping resistor so as to indicate the presence of a voltage.

8. Automatic mechanism appliance as claimed in claim 1, wherein said electronic circuit comprises at least one light-emitting diode mounted in parallel across a circuit branch comprising diodes adapted for developing a limited voltage when the circuit has a current flowing therethrough.

9. Automatic mechanism appliance as claimed in claim 1, wherein several light-emitting components are incorporated in the removable label, each of these components being connected electrically to particular conductors for simultaneously observing the state of several electric voltage and/or current parameters of the appliance.

10. Automatic mechanism appliance as claimed in claim 9, wherein said conductors are three in number and are connected to diode means for detecting the absence of voltage in one of the phases of a three phase supply network.

11. Automatic mechanism appliance as claimed in claim 1, wherein said label comprises retention means adapted for receiving and holding in position a conventional label on the surface portion which is devoted to the representation of characters.

12. Automatic mechanism appliance as claimed in claim 11, wherein said conventional label is made from a material which can be illuminated by light-emitting means.

13. Automatic mechanism appliance as claimed in claim 11, wherein said conventional label is insulating and protects a terminal carried by the body of the signalling label.

* * * * *